US008974205B2

(12) United States Patent
Lessmann et al.

(10) Patent No.: US 8,974,205 B2
(45) Date of Patent: Mar. 10, 2015

(54) PROGRESSING CAVITY GAS PUMP AND PROGRESSING CAVITY GAS PUMPING METHOD

(75) Inventors: Lorenz Lessmann, Pomerode/SC (BR); Ramiro Duarte Trapp, Pomerode/SC (BR); Elimar Volkmann, Pomerode/SC (BR); Gabriel Starke, Pomerode/SC (BR); Osnildo Borchardt, Pomerode/SC (BR)

(73) Assignee: NETZSCH-Mohopumpen GmbH (DE)

( * ) Notice: Subject to any disclaimer, the term of this patent is extended or adjusted under 35 U.S.C. 154(b) by 760 days.

(21) Appl. No.: 13/102,624

(22) Filed: May 6, 2011

(65) Prior Publication Data

US 2012/0282128 A1 Nov. 8, 2012

(51) Int. Cl.
*F04C 29/02* (2006.01)
*F04C 29/04* (2006.01)
*F04C 18/107* (2006.01)

(52) U.S. Cl.
CPC ..... *F04C 29/025* (2013.01); *F04C 29/028* (2013.01); *F04C 29/04* (2013.01); *F04C 18/1075* (2013.01)
USPC ..... 418/87; 418/97; 418/100

(58) Field of Classification Search
USPC ..... 418/83, 87, 97, 100
See application file for complete search history.

(56) References Cited

U.S. PATENT DOCUMENTS 2,463,341 A * 3/1949 Wade ..... 418/48
2,826,152 A * 3/1958 Michie ..... 418/48
2,862,454 A * 12/1958 Alcock ..... 418/48
4,080,119 A * 3/1978 Eriksson ..... 418/97
4,836,759 A * 6/1989 Lloyd ..... 418/56
5,653,585 A * 8/1997 Fresco ..... 418/100
5,820,354 A 10/1998 Wild et al.
6,041,856 A * 3/2000 Thrasher et al. ..... 166/53
6,945,755 B2 * 9/2005 Zupanick et al. ..... 418/48
7,413,416 B2 * 8/2008 Bratu ..... 418/48
2009/0068024 A1 3/2009 Amburgey et al.
2010/0028165 A1 * 2/2010 Kameya et al. ..... 418/83

FOREIGN PATENT DOCUMENTS

DE 2708527 A1 9/1977
DE 3712270 A1 10/1988
DE 4330226 C1 9/1994
DE 19849098 A1 4/2000
DE 102004050412 A1 5/2005

* cited by examiner

*Primary Examiner* — Mary A Davis
(74) *Attorney, Agent, or Firm* — St. Onge Steward Johnston & Reens LLC

(57) ABSTRACT

A progressing cavity gas pump with a stator which has a stator interior with an elastomeric inner surface as well as a gas outlet and a gas inlet, between which a pump delivery direction is defined, and with a rotor which engages with the stator interior, wherein below the stator, a lubricant reservoir is arranged which is connected via lubricant conduit devices to the stator interior. A progressing cavity gas pumping method using a progressing cavity gas pump, gas coming from a gas inlet is delivered with a rotationally driven rotor within a stator and through a stator interior having an elastomeric inner surface to a gas outlet and is compressed, and wherein from a lubricant reservoir below the stator, a lubricant supply to the stator interior takes place via lubricant conduit devices, and lubricant from the stator interior is recycled via the lubricant conduit devices into the lubricant reservoir.

7 Claims, 2 Drawing Sheets

PROGRESSING CAVITY GAS PUMP AND PROGRESSING CAVITY GAS PUMPING METHOD

FIELD OF THE INVENTION

The present invention relates to a progressing cavity gas pump and a progressing cavity gas pumping method.

BACKGROUND OF THE INVENTION

From DE 10 2004 050 412 A1, a gas compressor is known which comprises a compression device for compressing gas by operating two helical rotors which are in engagement with each other. Within its housing, this gas compressor comprises, among other things, a lubricant chamber and a rotor chamber, wherein the latter is sealed by seals against penetrating lubricant such as, e.g. oil and lubricating grease.

From DE 19849098 A1, the use of a progressing cavity gas pump as displacement machine for delivering and compressing gas, preferably as vacuum pump, is known. It is also proposed therein that said inner screw pump is configured in a completely dry-running manner so that no supply of the known operating fluids such as water or oil is required in the working space or in the other areas of the machine. In this case, only a one-time lifetime grease lubrication for bearing and gearing is to be carried out in the factory, wherein the bearings can be configured as hybrid bearings, thus ceramic balls in steel rings, and the stationary internally toothed gear wheel can optionally be configured as plastic gear wheel.

SUMMARY OF THE INVENTION

Apart from that it is known from practice that progressing cavity pumps with a rotor and a stator are widely used for delivering such media which are composed of liquids, solids and liquids, as well as liquids and gases in many different concentrations. Here, the liquids or liquid parts serve for lubricating and also cooling the pump. In the case that only gas is to be delivered, no lubricating or cooling effect is available in this known uses, and dry running between rotor and stator takes place. In absence of lubrication, the pump rotor rotating within the stator generates frictional heat which results in a local overheating of the elastomer from which at least the inside of the stator is made. Thereby, this elastomer loses first its elastic properties and is subsequently subjected to carbonization if oxygen is present because the material-related temperature limits for the elastomere are exceeded. Associated with this are not only downtimes for repair and maintenance but also losses with regards to the pumped quantities so that progressing cavity gas pumps of this type cannot be used in an optimal manner for delivering or compressing gas.

Thus, it is the object of the present invention to improve progressing cavity gas pumps.

The invention achieves this object by provision of a progressing cavity gas pump and a progressing cavity gas pumping method as described herein.

Accordingly, the invention provides a progressing cavity gas pump with a stator which has a stator interior with an elastomeric inner surface as well as a gas outlet and a gas inlet, whereby from the gas inlet to the gas outlet, a pump delivery direction is defined, and with a rotor which engages with stator interior and is rotatably drivable, wherein upstream of the stator, a lubricant reservoir is arranged which is connected via lubricant conduit devices with the stator interior.

Preferably, the lubricant conduit devices comprise a lubricant feed line from the lubricant reservoir to the stator interior and a lubricant return line from the stator interior to the lubricant reservoir. It is further preferred to integrate a throttle nozzle into the lubricant feed line.

A further preferred configuration is that an anterior pump chamber is provided which, with respect to the pump delivery direction, is connected on the inlet side to the stator interior and that the gas inlet opens out into the anterior pump chamber. In particular, it can further be provided that the rotor or a rotor drive device is guided through the anterior pump chamber. Alternatively or additionally, the lubricant feed line can open out into the anterior pump chamber, wherein it is further preferred that the opening of the lubricant feed line into the anterior pump chamber is upstream of the gas inlet so that gas to be pumped or to be compressed only gets into the anterior pump chamber if lubricant has already been fed.

Suitable previously explained configurations can be further developed in that in the pump delivery direction, a distributor having a gas branch-off extending upward to the gas outlet and having a lubricant branch-off extending downward to the lubricant return line is connected to an outlet of the stator interior so that due to gravity, lubricant reaches the lubricant return line and gets into the lubricant reservoir.

Yet another preferred configuration provides that the lubricant reservoir is designed for cooling the lubricant contained therein and in particular the lubricant recycled from the stator interior.

Furthermore, it can preferably be provided that the lubricant reservoir is a lubricating oil reservoir or lubricating oil tank and/or that a gear motor is contained for rotationally driving the rotor.

The object of the invention is also achieved with a progressing cavity gas pumping method, wherein in a progressing cavity gas pump, gas coming from a gas inlet is delivered with a rotationally driven rotor within a stator and through a stator interior having an elastomeric inner surface to a gas outlet and is compressed, whereby from the gas inlet to the gas outlet, a pump delivery direction is defined, and wherein from a lubricant reservoir below the stator, a lubricant supply to the stator interior takes place via lubricant conduit devices, and lubricant from the stator interior is recycled via the lubricant conduit devices into the lubricant reservoir.

Further preferred configurations are provided in

- that due to the arrangement of the lubricant reservoir below the stator, at or downstream of an outlet of the stator interior, a gravitational separation of lubricant and gas takes place, and/or
- that lubricant cools or is cooled in the lubricant reservoir, and/or
- that lubricant is conveyed through the lubricant conduit devices which comprise a lubricant feed line from the lubricant reservoir to the stator interior and a lubricant return line from the stator interior to the lubricant reservoir, and that the lubricant flow in the lubricant feed line is throttled by a throttle nozzle, and/or
- that gas from the gas inlet is directed into an anterior pump chamber from where it gets into the stator interior, wherein it is further preferred that lubricant is fed through the lubricant feed line at one position into the anterior pump chamber before the gas is conveyed from the gas inlet into the anterior pump chamber so that gas to be pumped or to be compressed only gets into the anterior pump chamber if the lubricant has already been fed, and/or wherein, in particular, the gas is conveyed in the pump delivery direction from an outlet of the stator interior and in a distributor with an upwardly extending gas branch-off to the gas outlet and with a downwardly extending branch-off to the lubricant return line so that due to gravity, lubricant reaches the lubricant return line and gets into the lubricant reservoir which can preferably be further developed in that by the pressure acting on a lubricant column in the lubricant return line and in the lubricant reservoir, lubricant is pressed from the lubricant reservoir via the lubricant feed line via the anterior pump chamber into the stator interior located above the lubricant reservoir, and/or that the rotor is rotatably driven by means of a gear motor.

The procedural solution can preferably be further developed through the different configurations according to and analog to the above device variants and vice versa. Further preferred and/or advantageous configurations of the invention arise from the claims and their combinations as well as the complete present filing documents.

BRIEF DESCRIPTION OF THE DRAWINGS

The invention is illustrated in more detail hereinafter only exemplary by means of exemplary embodiments with reference to the drawing, wherein.

DETAILED DESCRIPTION OF THE INVENTION

Figure 1:
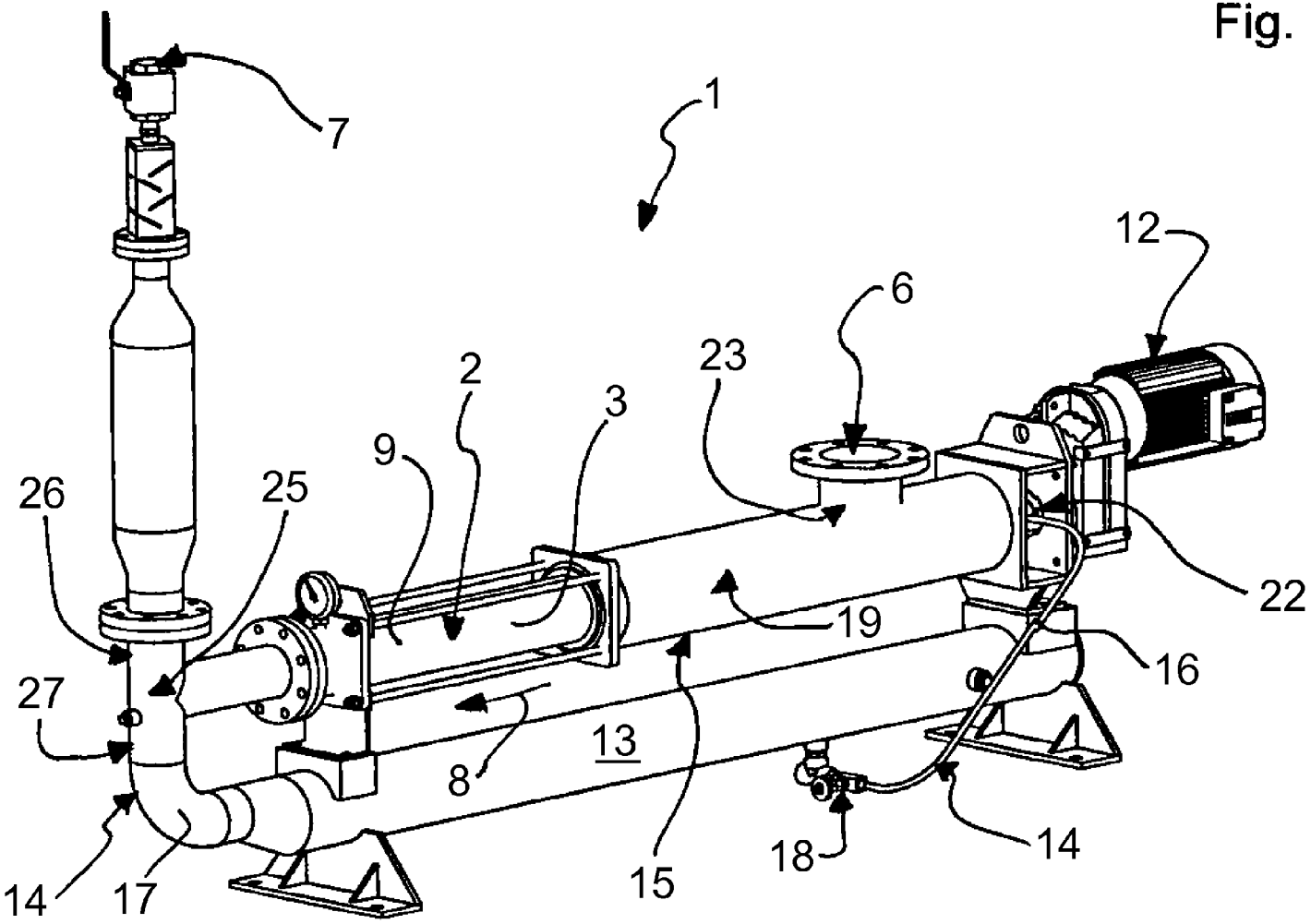
FIG. 1 shows in a perspective schematic illustration a first exemplary embodiment of a progressing cavity gas pump.

The invention is illustrated in more detail only exemplary by means of the exemplary embodiment and example of use described below and illustrated in the drawings, i.e., it is not limited to said exemplary embodiment and example of use or the complete feature combination within said exemplary embodiment and example of use.

Also, device and method features arise in each case analog from the pictorial and written descriptions of methods and devices.

Individual features described and/or illustrated in connection with the concrete exemplary embodiment are not limited to this exemplary embodiment or the combinations of remaining features but can be combined within the technical possibilities with any other variants, even if they are not treated separately in the present documents, and in particular with features and configurations of other implementation forms.

Identical reference numbers in the individual figures and pictures of the drawing designate identical or similar or identically or similarly acting components. Due to the illustrations in the drawing, also such features become apparent which are not provided with reference numbers regardless of whether such features are described hereinafter or not. On the other hand, features which are included in the present description but are not visible or illustrated in the drawing are readily understandable for a person skilled in the art. Further, the reference number list at the end of this description is explicitly part of this description.

Figure 2:
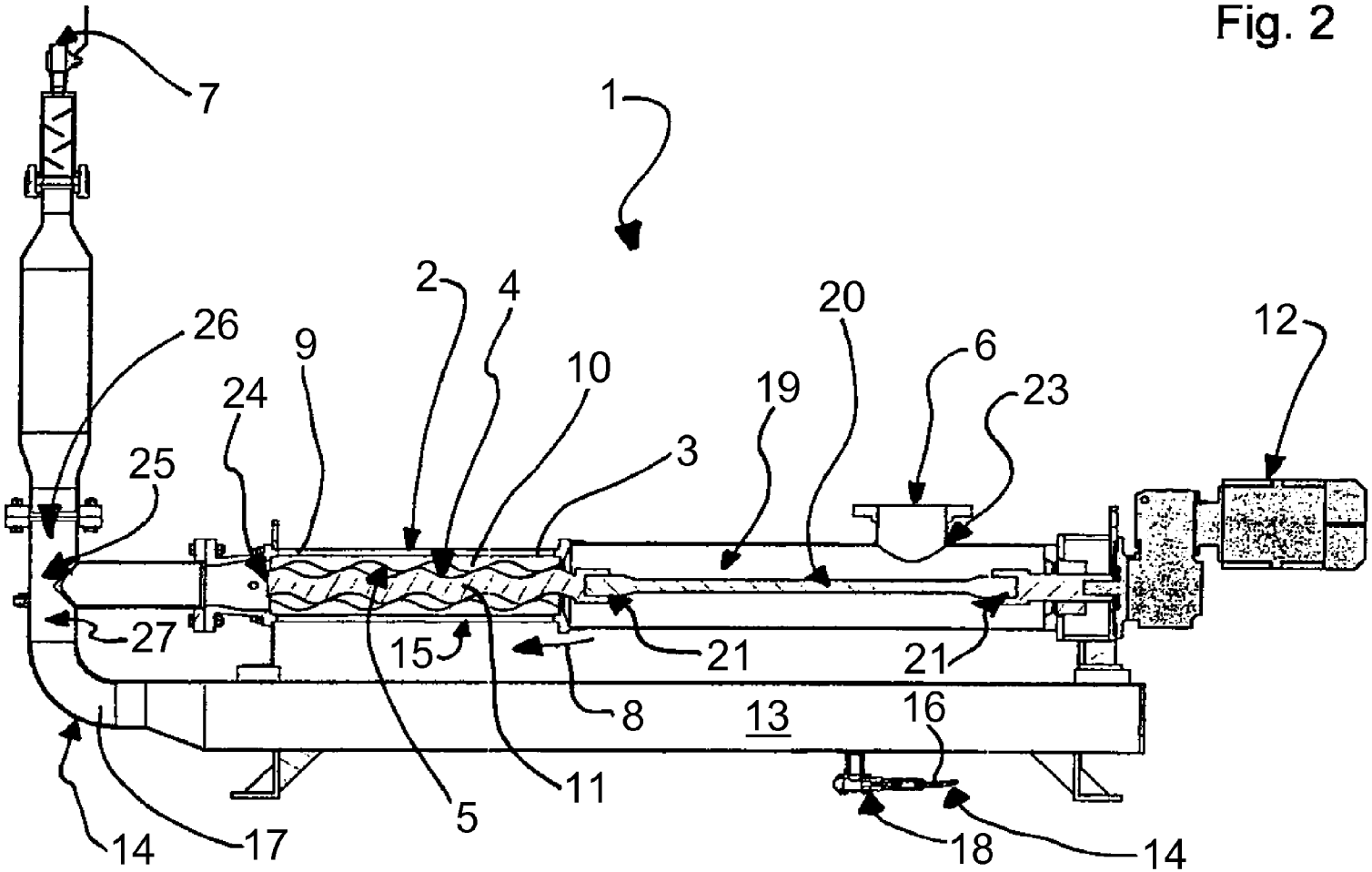
FIG. 2 shows a schematic partial longitudinal section for clarifying further details of the first exemplary embodiment of the progressing cavity gas pump of FIG. 1.

In the FIGS. 1 and 2, an exemplary embodiment of a progressing cavity gas pump 1 is shown in each case schematically in a perspective view and a partial longitudinal section, respectively. Such progressing cavity gas pumps 1 can be used, for example, for compressing natural gas which occurs during crude oil production so that the natural gas can be obtained, distributed and used as independent energy source.

As is clearly shown in detail in FIG. 2, said progressing cavity gas pump 1 comprises a stator 2 which, within a housing 3, has a stator interior 4 with an elastomeric inner surface 5 as well as a gas inlet 6 and a gas outlet 7, whereby from gas inlet 6 to gas outlet 7, a pump delivery direction (arrow 8) is defined. The housing 3 of the stator 2 comprises a rigid outer casing 9 in which an elastic screw pipe 10, for example made from an elastomer, is seated and forms or provides the elastomeric inner surface 5. The progressing cavity gas pump 1 comprises further a rotor 11 which engages with the stator interior 4 and is rotatably drivable. For rotatably driving the rotor 11, a gear motor 12 is included. Such designs are commonly used and are well known to the person skilled in the art so that it is not necessary here to further discuss the structural and design-related possibilities of stator 2 and rotor 11, but reference is made to the relevant literature. In any case, all currently known versions can be used within the context of the present invention and are hereby incorporated by reference in this description.

Furthermore, below the stator 2, a lubricant reservoir 13 is arranged which is connected via lubricant conduit devices 14 to the stator interior 4. Due to the fact that the lubricant reservoir 13 is arranged on the lower side 15 of the stator 4 of the progressing cavity gas pump 1 and is connected via the lubricant conduit devices 14 to the stator interior 4, the delivery and/or compression of a medium (not shown) which consists 100% of gas is made possible. By arranging the lubricant reservoir 13 below the stator 4, a simple gravitational separation of lubricant (not shown) and gas (not shown) takes place. The actual pump component consisting of stator interior 4 with elastomeric inner surface 5 and the rotor 11 as well as the lubricant conduit devices 14 and the lubricant reservoir 13 form a lubricant circuit which also carries out a cooling and thus is also to be considered as cooling circuit. In any case, the lubricant circuit provides that the dry running mentioned above with respect to the prior art is prevented.

The lubricant conduit devices 14 comprise a lubricant feed line 16 (see FIG. 1) from the lubricant reservoir 13 to the stator interior 4 and a lubricant return line 17 from the stator interior 4 to the lubricant reservoir 13. In the lubricant feed line 16, a throttle nozzle or a throttle valve 18 is integrated. Furthermore, an anterior pump chamber 19 is provided which, with respect to the pump delivery direction (arrow 8), is connected on the inlet side or feed side to the stator interior 4. The gas inlet 6 opens out into the anterior chamber 19 which therefore is arranged upstream of the stator interior 4. A rotor drive shaft device 20 in the form of a shaft which is coupled via connecting devices 21 to the rotor 11 is guided through the anterior pump chamber 19. The lubricant feed line 16 opens out into the anterior pump chamber 19 in such a manner that the opening 22 of the lubricant feed line 16 into the anterior pump chamber 19 lies upstream of the opening 23 into the gas inlet 6 so that gas (not shown) to be pumped or to be compressed during normal operation gets only into the anterior pump chamber 19 if lubricant has already been fed, whereby a lubrication of the rotor 11 or the rotor drive shaft device 20 in the anterior pump chamber 19 is ensured from the beginning and no region through which gas (not shown) flows is without lubrication.

Viewed in pump delivery direction (arrow 8) or gas flow direction within the stator interior 4, a distributor 25 with a gas branch-off 26 extending upward to the gas outlet 7 and a lubricant branch-off 27 extending downward to the lubricant return line 17 is connected to an outlet 24 of the stator interior 4 so that due to gravitation, lubricant (not shown) reaches the lubricant return line 17 and gets into the lubricant reservoir 13. Thus, a simple and reliable separation of gas and lubricant takes place (both not shown). The gas (not shown) flowing into the anterior pump chamber 19 is mixed with the injected lubricant (not shown) such as, e.g. oil, from the lubricant reservoir 13 arranged below the stator interior 4, and the gas and the lubricant (both not shown) are fed together through the stator interior 4 to the pressure side towards the distributor 25. The mixture of gas and lubricant (both not shown) arriving at the distributor 25 separates automatically due to gravity: The gas (not shown) is discharged upwardly through the distributor 25 via the gas branch-off 26 to the gas outlet 7 and the lubricant (not shown) flows downward in the distributor 25 via the lubricant branch-off 27 and the lubricant return line 17 into the lubricant reservoir 13 where the lubricant (not shown) can additionally cool down in order to be able to absorb later in the circuit the heat again generated by friction and gas compression during the operation of the progressing cavity gas pump 1. In trials, a maximum lubricant or oil temperature of 80° was detected.

When gas with a concentration of 100% flows into the progressing cavity gas pump 1 and is fed with the rotor 11 in the stator interior 4 towards the outlet 24, which also defines the pressure side, and is compressed, then, an increased pressure is also available in the lubricant return line 17, which can also be designated as pressure port, wherein the pressure acts on the lubricant (not shown) in the lubricant return line 17 and in the lubricant reservoir 13. Thus, the pressure acting on the lubricant column in the lubricant return line 17 and in the lubricant reservoir 13 causes that lubricant (not shown) from the lubricant reservoir 13 such as, for example, a lubricant tank, is pressed via the lubricant feed line 16 via the anterior pump chamber 19 into the stator interior 4 located above the lubricant reservoir 13. The aforementioned throttle nozzle 18 in the circuit in the lubricant feed line 16 then ensures that the pressure at the gas outlet 7 does not drop or not too much because of the lubricant circuit.

The invention is illustrated in an exemplary manner only by means of the exemplary embodiments in the description and in the drawing and is not limited thereto but comprises all variations, modifications, substitutions and combinations which the person skilled in the art can derive from the present documents in particular within the context of the claims and the general descriptions in the introductory part of the description as well as the description of the exemplary embodiments and their illustrations in the drawing and can combine with his/her specialized knowledge as well as the prior art, in particular the disclosures of the aforementioned own prior publications. In particular, all individual features and configuration possibilities of the invention and its embodiment variants can be combined.

What is claimed is:

1. A progressing cavity gas pump comprising:

a stator which has a stator interior with an elastomeric inner surface, a gas outlet and a gas inlet, whereby from the gas inlet to the gas outlet, a pump delivery direction is defined, a rotor which engages with the stator interior, and a lubricant reservoir arranged below the stator which is connected via lubricant conduit devices to the stator interior, wherein due to the arrangement of the lubricant reservoir below the stator, at or downstream of the outlet of the stator interior, a gravitational separation of lubricant and gas takes place, wherein the lubricant conduit devices comprise a lubricant feed line from the lubricant reservoir to the stator interior and a lubricant return line from the stator interior to the lubricant reservoir, wherein an anterior pump chamber is provided which, with respect to the pump delivery direction, is connected on an inlet side to the stator interior, and that the gas inlet opens out into the anterior pump chamber, wherein a rotor drive shaft extends through the anterior pump chamber upstream of the gas inlet and connects to the rotor;

wherein the lubricant feed line opens out into the anterior pump chamber, wherein the opening of the lubricant feed line into the anterior pump chamber lies upstream of the opening of the gas inlet and lubricating the entire length of the rotor drive shaft within the anterior pump chamber ensuring that no region through which gas flows is without lubrication, wherein in the pump delivery direction, a distributor having a gas branch-off extending to the gas outlet and a lubricant branch-off extending to the lubricant return line is connected to the gas outlet of the stator interior so that due to gravity, lubricant reaches the lubricant return line and gets into the lubricant reservoir.

2. The progressing cavity gas pump of claim 1, wherein a throttle valve is integrated in the lubricant feed line.

3. The progressing cavity gas pump of claim 1, wherein the rotor extends in the anterior pump chamber.

4. The progressing cavity gas pump of claim 1, wherein the lubricant reservoir is designed for cooling the lubricant contained therein and in particular the lubricant recycled from the stator interior.

5. The progressing cavity gas pump of claim 1, further comprising a gear motor for rotatably driving the rotor.

6. A progressing cavity gas pumping method comprising:

delivering and compressing gas from a gas inlet to a progressing cavity gas pump with a rotationally driven rotor within a stator and through a stator interior having an elastomeric inner surface to a gas outlet, where a pump delivery direction is defined from the gas inlet to the gas outlet; and supplying a lubricant supply to the stator interior from a lubricant reservoir below the stator, such that supplying takes place via lubricant conduit devices, and lubricant from the stator interior is recycled via the lubricant conduit devices into the lubricant reservoir, wherein due to the arrangement of the lubricant reservoir below the stator, at or downstream of the outlet of the stator interior, a gravitational separation of lubricant and gas takes place, wherein lubricant is conveyed through the lubricant conduit devices which comprise a lubricant feed line from the lubricant reservoir to the stator interior and a lubricant return line from the stator interior to the lubricant reservoir, and that the lubricant flow in the lubricant feed line is throttled by a throttle nozzle, wherein lubricant is fed through the lubricant feed line at one position into an anterior pump chamber before the gas is conveyed from the gas inlet into the anterior pump chamber, providing rotational input from a rotor drive shaft extending through the anterior pump chamber upstream of the gas inlet to the rotor, lubricating the entire length of the rotor drive shaft within the anterior pump chamber ensuring that no region through which gas flows is without lubrication, wherein that by the pressure acting on a lubricant column in the lubricant return line and in the lubricant reservoir, lubricant is pressed from the lubricant reservoir via the lubricant feed line via the anterior pump chamber into the stator interior located above the lubricant reservoir.

7. The progressing cavity gas pumping method of claim 6, wherein lubricant cools or is cooled in the lubricant reservoir.

* * * * *